US005911622A

United States Patent [19]

Kinoshita et al.

[11] Patent Number: 5,911,622

[45] Date of Patent: Jun. 15, 1999

[54] COIN LINE-UP DEVICE, DEVICE FOR RECEIVING AND DISPENSING COINS SEPARATELY ACCORDING TO MONETARY DENOMINATIONS AND CIRCULATION TYPE COIN TAKE IN AND OUT MACHINE

[75] Inventors: Shigefumi Kinoshita; Tosio Hara; Koshi Hatanaka, all of Kanagawa; Nobuyuki Nakatani, Hyogo, all of Japan

[73] Assignees: Fuji Electric Co., Ltd., Kawasaki, Japan; Wing Design Co., Priv., Himeji, Japan

[21] Appl. No.: 08/757,401

[22] Filed: Nov. 27, 1996

[30] Foreign Application Priority Data

Nov. 30, 1995 [JP] Japan ..... 7-312923

[51] Int. Cl.[6] ..... G07D 3/02

[52] U.S. Cl. ..... 453/11; 453/40; 453/57

[58] Field of Search ..... 453/3, 4, 7, 11, 453/20, 40, 21, 41, 49, 57, 61, 62, 63

[56] References Cited

U.S. PATENT DOCUMENTS

| | | | |
|---|---|---|---|
| 3,401,704 | 9/1968 | Jullien-Davin | 453/41 X |
| 3,662,770 | 5/1972 | Cohen | 453/40 |
| 4,047,538 | 9/1977 | Sahni | 453/40 |

FOREIGN PATENT DOCUMENTS

| | | | |
|---|---|---|---|
| 3-147090 | 6/1991 | Japan | 453/61 |
| 4-111090 | 4/1992 | Japan . | |
| 4-86977 | 7/1992 | Japan . | |
| 2 260 212 | 4/1993 | United Kingdom | 453/57 |

*Primary Examiner*—F. J. Bartuska

*Attorney, Agent, or Firm*—Finnegan, Henderson, Farabow, Garrett & Dunner, L.L.P.

[57] ABSTRACT

A coin line-up device includes a rotary cylinder having an upper opening as a coin receiving inlet, the rotary cylinder being laid substantially horizontally with a central axis thereof inclined with a predetermined angle, and a unit for rotating the rotary cylinder. The predetermined angle of the central axis is in a range of from 30° to 30°, and the following expression is satisfied: $d<D<\{(d+t)^2+d^2/4\}/(d+t)$ where d is the diameter of a coin to be stood up, t is the thickness of the coin, and D is the inside diameter of the rotary cylinder. The speed of rotation of the rotary cylinder is in a range of from 2 rps to 5 rps. Also, a device for receiving and dispensing coins separately according to monetary denominations includes the above coin line-up device. Further, a circulation-type coin take in and out machine includes the above coin line-up device.

18 Claims, 7 Drawing Sheets

50 YEN

1 YEN

100 YEN

5 YEN

500 YEN

10 YEN

COIN LINE-UP DEVICE, DEVICE FOR RECEIVING AND DISPENSING COINS SEPARATELY ACCORDING TO MONETARY DENOMINATIONS AND CIRCULATION TYPE COIN TAKE IN AND OUT MACHINE

BACKGROUND OF THE INVENTION

1. Field of the Invention

This invention relates to a circulation type coin take in and out machine which utilizes the coins for monetary payment transactions which have been received in monetary receipt transactions, and more particularly to a device for storing and dispensing coins separately according to monetary denominations, and a coin line-up device.

2. Description of the Related Art

In general, a circulation type coin take in and out machine includes: a coin receiving and dispensing section for dispensing a number of coins one by one which have been supplied to a coin receiving inlet at a time in such a manner that they are not lined up at all; a coin distinguishing section for transferring coins thus supplied one after another while distinguishing imitation coins from the original; a coin dividing section for dividing the good coins (which have been passed through the coin distinguishing section) separately according to the monetary denominations while transferring them; a storage section for storing coins separately according to monetary denominations which, as the name implies, stores the coins separately according to the monetary denominations which have been divided in the above-described manner; and a dispensation section for dispensing coins separately according to monetary denominations which, in response to a coin dispensing instruction issued during a monetary payment transaction, dispenses coins one at time from the section for storing coins separately according to monetary denominations.

In the case of a circulation type coin take in and out machine set at a store cashier, a window of a financial institution, and so forth, its height is limited. More specifically, there has been a strong demand for a reduction of the height of the machine so that a cash register is set on it. In order to meet this requirement, Japanese Patent Unexamined Publication No. Hei 4-111090 has disclosed a device for storing and dispensing coins separately according to monetary denominations in which the bottom surface of its coin storing section is made up of a dispensing belt which is stretched obliquely upwardly. Hence, the device is lower in height than the conventional one in which coins are stacked in coin storing cylinders which are held vertical, and coins are dispensed from the bottoms of those cylinders.

However, the above-described conventional device suffers from the following problems:

(1) In a monetary receipt transaction, coins divided separately according to the monetary denominations are merely dropped on the coin dispensing belts in the section for storing and dispensing coins separately according to the monetary denominations; that is, those coins are simply and carelessly stacked up with gaps between them (as if they were scraped up). This means that the above-described device is low in coin storing efficiency. Hence, in order to increase the coin storing capacity, it is necessary to increase the volume of the device itself. In the coin storing section, the coin storing capacity depends on how coins are stacked; that is, it is not constant. Its coin storing space should be large to some extent since the number of coins which can be accommodated therein is variable.

(2) In a monetary payment transaction, in response to a coin dispensing instruction, the coin dispensing belts are driven, and a heap of coins stacked and not lined are leveled one after another with a separating roller, and after they are laid in one layer and in one line, they are supplied one at a time. Hence, in order to dispense coins, which are held fallen down and lined, from a heap of coins stacked variously and not lined, for instance the bridging of coins makes even coins of one and the same monetary denomination different in coin dispensing time. Hence, in dispensing as many coins as required, it is necessary for the device to have an additional time at all times. As was described above, coins are dispensed successively after they have been laid in one layer and in one line with the separating roller. On the other hand, coins are different in diameter separately according to monetary denominations; in other words, different coins are different in diameter, and therefore different coins are different in coin dispensing time—especially a 1-yen coin (Japanese coin) smallest in diameter (20.0 mm in diameter) is clearly different in coin dispensing time from a 500-yen coin (Japanese coin) largest in diameter.

SUMMARY OF THE INVENTION

The present invention has been made in view of the foregoing, and therefore a first object of the invention is to provide a coin line-up device which quickly and positively changes a so-called "fall posture" of a coin that it is set on its side into a so-called "stand posture" that it stands on its cylindrical surface (or milled edge).

A second object of the invention is to provide a device for storing and dispensing coins separately according to monetary denominations, and a circulation type coin take in and out machine, each of which employs the coin line-up device, so that coins are lined up substantially horizontally instead of vertically thereby to reduce the height of the device, and to make the device compact in arrangement, thereby to increase the coin storing capacity and to standardize the coin dispensing time.

In order to solve the above-described problems, according to a first aspect of the invention, there is provided a coin line-up device which operates to stand a coin which is fallen down when inserted therein. The device employs a rotary cylinder as a coin turning means to continuously apply a frictional force to the coin along the periphery (or milled edge). The rotary cylinder is laid in such a manner that it is inclined but laid substantially horizontally. More specifically, the rotary cylinder has an upper opening as a coin receiving inlet, and is rotatable around its inclined central axis.

In the device, the predetermined angle of the central axis is preferably in a range of from 3° to 45°, more preferably 3° to 30°, most preferably about 5°.

Furthermore, in the device, it is preferable that the following expression (1) is satisfied:

$$d<D<\{(d+t)^2+d^2/4\}/(d+t) \quad (1)$$

where d is the diameter of a coin to be stood up, t is the thickness of the coin, and D is the inside diameter of the rotary cylinder.

Moreover, in the device, the speed of rotation of the rotary cylinder is preferably in a range of from 2 rps to 5 rps, more preferably 3.5 rps.

In addition, it is preferable that at least a part of the inner cylindrical surface of the rotary cylinder is a coin rubbing surface.

Furthermore, the device has rotary supporting mechanisms on the rotary cylinder at both ends which are in rolling contact with the outer cylindrical surface of the rotary cylinder.

Moreover, the device comprises a rotating mechanism having a driven wheel on the outer cylindrical surface of the rotary cylinder, and preferably the rotating mechanism is arranged on the side of the coin receiving inlet.

Next, what is provided according to a second aspect of the invention is a device for receiving and dispensing coins separately according to monetary denominations. The device comprises: the above-described coin line-up device; and coin dispensing means provided on the rotary cylinder at the lower end, which dispenses a coin per revolution of the rotary cylinder.

Preferably, the coin dispensing means has a coin jumping and discharging member.

In addition, what is provided according to a third aspect of the invention, is a circulation-type coin take in and out machine which comprises the above-described device for storing and dispensing coins separately according to monetary denominations.

Preferably, the device for storing and dispensing coins separately according to monetary denominations is of cassette type, being detachably mounted on the body of the machine.

The coin line-up device according to the first aspect of the invention operates as follows: In the case where a coin is easily inserted into the rotary cylinder through the upper opening which is laid horizontally, the coin is left fallen on the inner cylindrical surface of the rotary cylinder; however, in the case where a coin is inserted into the rotary cylinder which is being rotated, or the rotary cylinder is turned after a coin is inserted thereinto, the coin fallen down tends to stand (rise) from the lower portion of the inner cylindrical surface of the rotary cylinder towards the upper portion thereof; that is, the coin fallen down is not completely turned over—it is turned over in such a manner that it is not horizontally balanced. Hence, the inner cylindrical surface of the rotary cylinder produces a reaction to twist the coin surface, so that the periphery of the coin twisted when turned over contacts the inner cylindrical surface of the rotary cylinder again, whereby a force of turning over the coin thus fallen down is decreased; however, a rotary torque causing the periphery of the coin to rub the inner cylindrical surface of the rotary cylinder in the direction of a tangent thereto is allowed to act continuously for a while. Hence, as the rotary cylinder makes about one or two revolutions, the action of turning over the coin is suspended, and the coin is held stood by the rotary inertia (taking a standing posture). That is, the coin thus stood starts to turn in synchronization with the rotary cylinder with its periphery (milled edge) in contact with the lower portion of the inner cylindrical surface of the rotary cylinder.

The rotary cylinder is held inclined. Hence, the stood coin, which turns in synchronization with the rotary cylinder, is horizontally slid down the inner cylindrical surface of the rotary cylinder along the generating line thereof. If, in this case, the lower end of the rotary cylinder is closed, the sliding of the stood coin is stopped there. Hence, the coins inserted into the rotary cylinder successively are lined up therein in such a manner that they are held stood. Hence, in the case where the length of the rotary cylinder is less than twice or thrice as long as the diameter of the coin, the rotary cylinder laid horizontally performs a coin standing function. The stood coin may be rollingly discharged from the lower end of the rotary cylinder so that it is guided into another coin storing section.

In the case where the length of the rotary cylinder is longer than the above-described value, coins are horizontally lined up (a coin orderly-storing function); that is, a device is provided which stores coins in such a manner that they are held stood. In this case, the rotary cylinder is laid horizontally instead of vertically. Hence, a predetermined number of coins can be stored in such a manner that they are arranged in order, and the coin storing section can be reduced in height. The driving system adapted to turn the rotary cylinder is simpler in structure than that which employs a coin dispensing belt at the coin storing section. In addition, the width of the coin storing section can be reduced. The angle of inclination of the rotary cylinder can be extremely small— substantially horizontal. In the case where the angle of inclination of the rotary cylinder is large, for instance about 60°, the coin will slide down the inner cylindrical surface of the rotary cylinder; that is, the coin is difficult to stand; that is, in order to cause the coin to stand, it is necessary to provide a certain coin sliding distance. As the angle of inclination decreases, the force of turning over the coin becomes superior to the force of sliding the coin, so that the coin is smoothly stood up, and the distance required for standing the coin may be shorter, and the number of coins to be stored can be increased as much. In addition, the height of the coin storing section can be decreased. In order merely to stand a coin, the angle of inclination of the rotary cylinder may be any value. However, in order to decrease not only the coin sliding distance but also the height of the device, the angle of inclination of the rotary cylinder should be practically in a range of from 3° to 45°, more preferably 3° to 30°; however, it should be noted that angle of inclination depends on the states of the surfaces (patterns, and milled edges) of coins to be stored, and the states of the inner cylindrical surfaces of the rotary cylinders.

If the inside diameter D of the rotary cylinder is much larger than the diameter d of a coin to be stood up, the following difficulty is involved: When coins are inserted in rapid succession the bridging of coins occurs with high frequency. In addition, since the diameter is larger, the coins are not completely stood in line when lined up. In order to eliminate the bridging of the coin, the following expression should be satisfied with respect to the inside diameter D of the rotary cylinder:

$$d<D<\{(d+t)^2+d^2/4\}/(d+t)$$

where t is the thickness of a coin.

If the speed of rotation of the rotary cylinder is too low, the rotary inertia is not accelerated, and the coin is not stood up or it is not quickly stood up. If the speed of rotation of the rotary cylinder is 2 rps in minimum, then it is possible to cause the coin to stand up. If, on the other hand, the speed of rotation of the rotary cylinder is too high, then the centrifugal force is accelerated, so that the coin fallen down is revolved while being stuck to the inner cylindrical surface of the rotary cylinder, thus being unable to stand up. If the speed of rotation of the rotary cylinder is 5 rps in maximum, then the coin is stood up without being revolved.

In order to cause a coin to stand up, it is essential to produce a rotary torque continuously for a while which causes the periphery of a coin to rub the inner cylindrical surface of the rotary cylinder in the direction of a tangent thereto. In the case where the inner cylindrical surface of the rotary cylinder is smooth, the frictional force is small, and the rotary torque is insufficient, so that it is difficult for the coin to stand up. In order to eliminate this difficulty, at least a part of the inner cylindrical surface of the rotary cylinder is made rough (being formed into a coin rubbing surface). In this case, the periphery of the coin is positively brought into frictional contact with the coin rubbing surface, and therefore the coin is positively stood up. The coin rubbing surface may be formed by roughening the inner cylindrical surface of the rotary cylinder, or by forming a plurality of holes therein. The holes thus formed function also as holes through which dust stuck onto the coins are removed or as holes which break the jamming of coins. Furthermore, in the case where wet coins are to be stood up, the holes may be utilized for removal of centrifuged water droplets therefrom. It goes without saying that the rotary cylinder may be made by using a porous material or a net material.

The coin line-up device has rotary supporting mechanisms on the rotary cylinder at both ends which are in rolling contact with the outer cylindrical surface of the rotary cylinder. In this case, a long rotary cylinder can be supported with ease, and the frictional loss is reduced as much.

Moreover, the device comprises a rotating mechanism having a driven wheel on the outer cylindrical surface of the rotary cylinder, which simplifies the arrangement of the driving system as much. In the case where the rotating mechanism is arranged on the side of the coin receiving inlet, the space defined by the bottom of the body of the machine and the coin receiving inlet of the rotary cylinder can be effectively utilized, which makes it possible to decrease the height of the device.

The device for storing and dispensing coins separately according to monetary denominations, according to the second aspect of the invention, comprises: the coin dispensing means which is provided on the rotary cylinder at the lower end, to dispenses a coin per revolution of the rotary cylinder. The stood coin at the lower end of the rotary cylinder is turned in such a manner that it is eccentric and loose to some extent. In the horizontally laid rotary cylinder, the weight of the lined-up coins is scarcely applied to the coin dispensing means which dispenses a coin per revolution. Hence, the coin dispensing mean can be readily formed by utilization of the rotation of the rotary cylinder. In the device, the coin discharged is jumped up by means of the coin jumping and discharging member. Hence, without use of special conveying means, the jumped coin covers the head drop of the rotary cylinder, and regains a potential for dropping into the coin dispensing outlet.

A specific feature of the circulation type coin taken in and out machine, according to the third aspect of the invention, resides in that it comprises the above-described device for storing and dispensing coins separately according to the monetary denominations, Hence, the number of coins to be stored is increased, and the dispensing of coins at a constant rate is realized. In addition, the coin storing section can be decreased in height, and it is possible to make the device compact. Furthermore, the rotating drive system, and the coin dispensing mechanism are simplified, which results in that the device is simplified as a whole, and the number of components is decreased as much. Furthermore, the coin storing section can be decreased in width.

In addition, the device for storing and dispensing coins separately according to the monetary denominations is provided in the form of a cassette which can be detachably loaded in the body of machine. This feature enhances one lump collection of coins, and contributes to the maintenance and inspection of the device.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

One preferred embodiment of the invention will be described with reference to the accompanying drawings.

Figure 1:
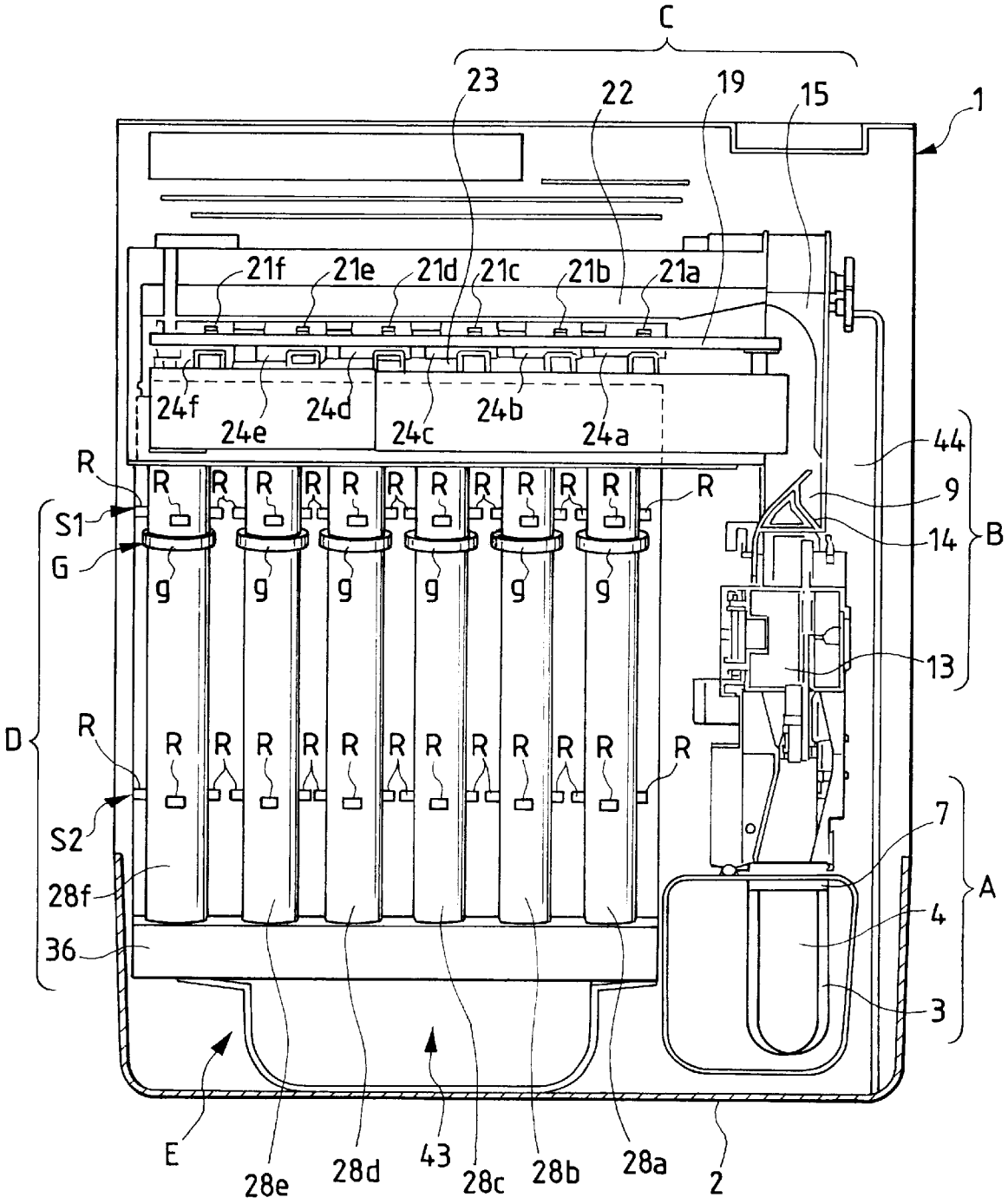
FIG. 1 is a plan view showing the interior of a circulation type coin take in and out machine according to an embodiment of the invention.
Figure 2:
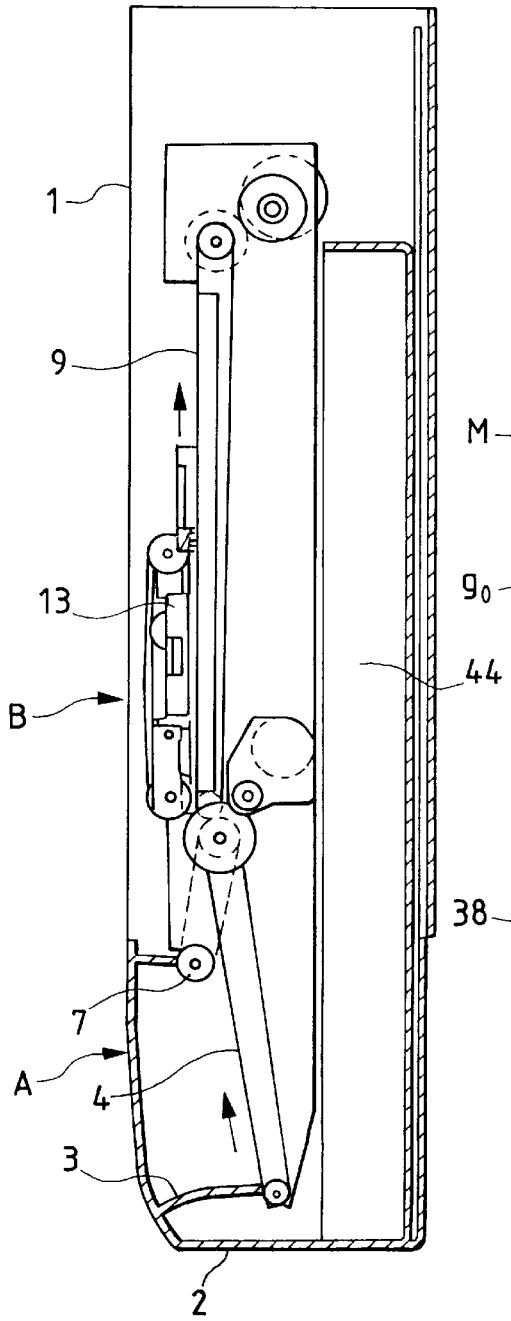
FIG. 2 is a vertical sectional right side view showing the machine shown in FIG. 1.
Figure 3:
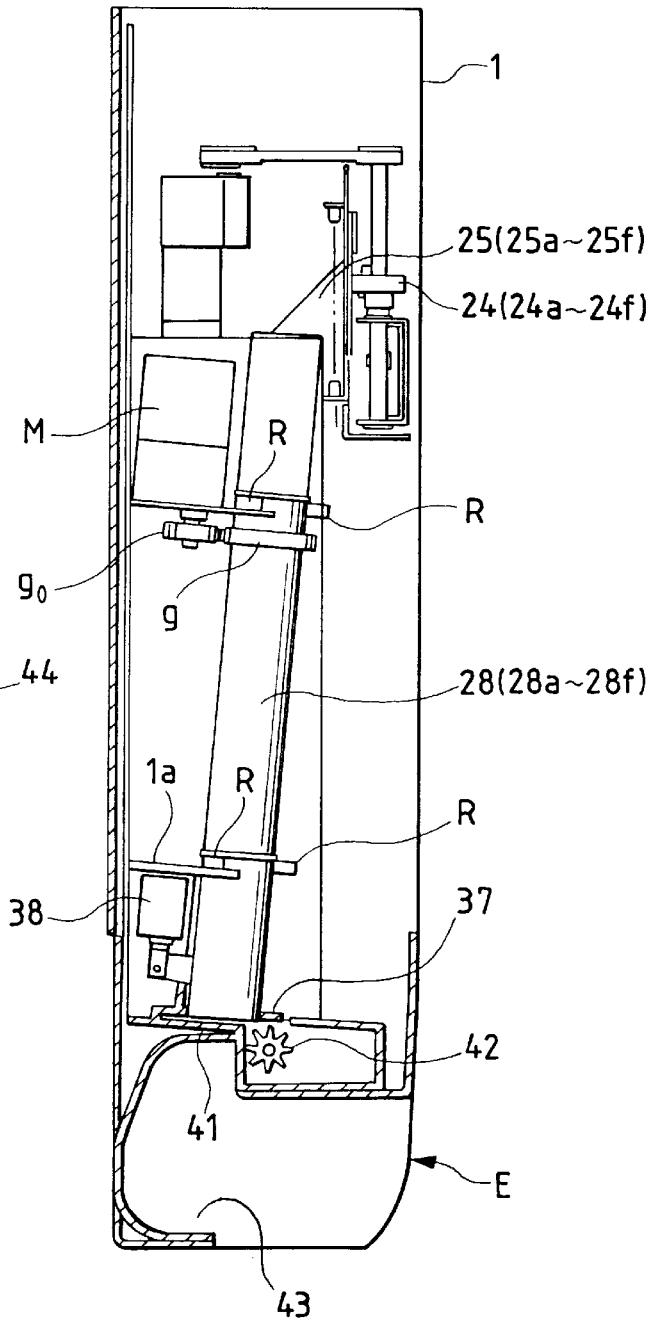
FIG. 3 is a vertical sectional left side view showing the machine shown in FIG. 1.
Figure 4:
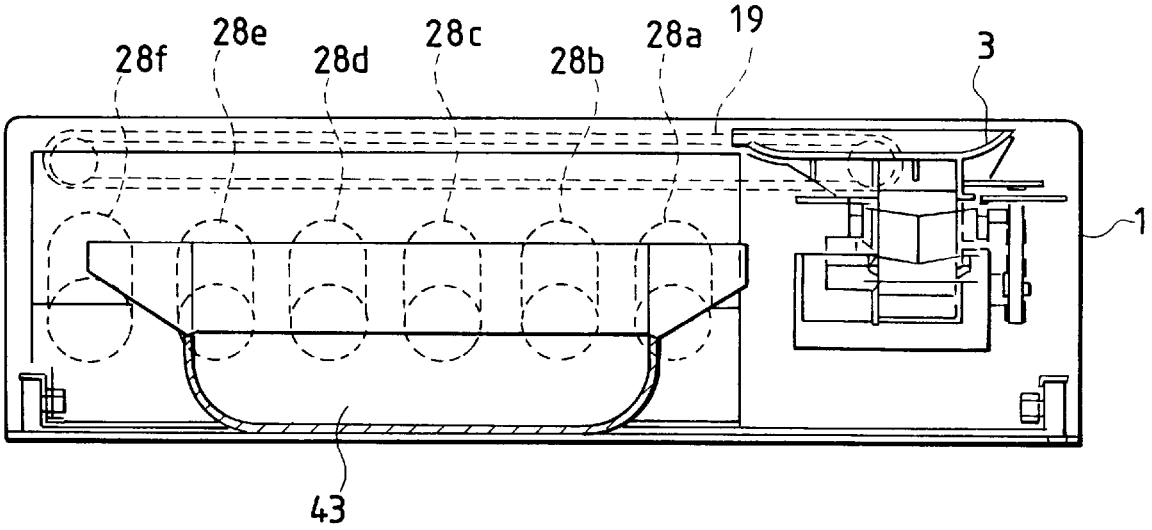
FIG. 4 is a vertical sectional front view showing the machine shown in FIG. 1.

FIG. 1 is a plan view of a circulation type coin take in and out machine, the embodiment of the invention, showing the interior thereof, FIG. 2 is a vertical sectional right side view of the machine, FIG. 3 is a vertical sectional left side view of the machine, and FIG. 4 is a vertical sectional front view of the machine.

The circulation type coin take in and out machine comprises: a coin receiving and dispensing section A which has a coin receiving inlet 3 on the right side of a front panel 2 covering the upper portion of a machine body 1, and dispenses a number of coins one by one which have been supplied to the coin receiving inlet 3 at a time in such a manner that they are not lined up at all; a coin distinguishing section B which transfers the coins thus supplied one after another while distinguishing imitation coins from the original; a coin sorting section C for sorting the good coins (which have been passed through the coin distinguishing section) separately according to the monetary denominations while transferring them; a section D for storing and dispensing coins separately according to monetary denominations which stores the coins separately according to the monetary denominations which have been sorted out in the above-described manner, and dispenses them one at a time in response to a coin dispensing instruction issued during monetary payment transaction; and a dispensing coin guide section E which guides coins to a coin dispensing outlet 43 which have been dispensed in the above-described manner.

The coin receiving and dispensing section A, as shown in FIG. 2, comprises: a coin dispensing endless belt 4 which forms the bottom of the coin receiving inlet 3, and laid obliquely upwardly; and a reversely-sending roller 7 provided in the coin dispensing region of the coin dispensing endless belt 4, to collapse a heap of coins on the coin dispensing endless belt 4 thereby to arrange the coins in one layer and in one line.

The coin distinguishing section B comprises: a coin conveying endless belt 9 which is extended from the coin receiving and dispensing section A towards the back of the machine body 1; a coin distinguishing unit 13 which covers the middle of the coin conveying endless belt 9; and a lift-type coin dividing gate 14 (FIG. 1) which causes imitation coins or unacceptable coins to drop into an over-flow box 44.

The coin sorting section C, as shown in FIG. 1, comprises: a corner guide 9 which changes the direction of each coin at right angle which has been conveyed by the coin distinguishing section in the direction of the rear surface; a coin slide surface which is extended horizontally in the back of the machine body 1; a coin retaining and conveying belt 19 which conveys each coin to the left while supporting it from above; a reference rail 22 which guides each coin while regulating the position of the edge of the coin; a 1-yen coin selecting hole 24*a*, 50-yen coin selecting hole 24*b*, 5-yen coin selecting hole 24*c*; 100-yen coin selecting hole 24*d*, 10-yen coin selecting hole 24*e*, and 500-yen coin selecting hole 24*f*, all of which are arranged along the coin slide surface 23; and conical rollers 21*a* through 21*f* which press coins through the coin retaining and conveying belt 19 which are to be slidably conveyed into the coin selecting holes 24*a* through 24*f*.

Furthermore, in the embodiment, the section D for storing and dispensing coins separately according to the monetary denominations, as shown in FIGS. 1, 3, 4 and 5, is in the form of a cassette which is detachably set in the machine body 1. The section D comprises: coin chutes 25*a* through 25*f* provided separately according to the momentary denominations, which have coin receiving inlets just below the above-described coin selecting holes 24*a* through 24*f*; rotary cylinders 28*a* through 28*f* provided separately according to the momentary denominations which employ their upper open ends as coin receiving inlets, and are slightly tilted forwardly (about 5°) and which are each rotatable about its central axis; roller support mechanism S1 and S2 which are arranged on the upper and lower sides of the rotary cylinders 28*a* through 28*f*; a rotating mechanism G provided near the roller support mechanism S1; and coin dispensing mechanisms 36 (36*a* through 36*f*) provided separately according to the momentary denominations which are located below the rotary cylinders 28*a* through 28*f*. Each of the coin dispensing mechanisms 36 operates to dispense one coin whenever the respective rotary cylinder makes one revolution.

Figure 5:
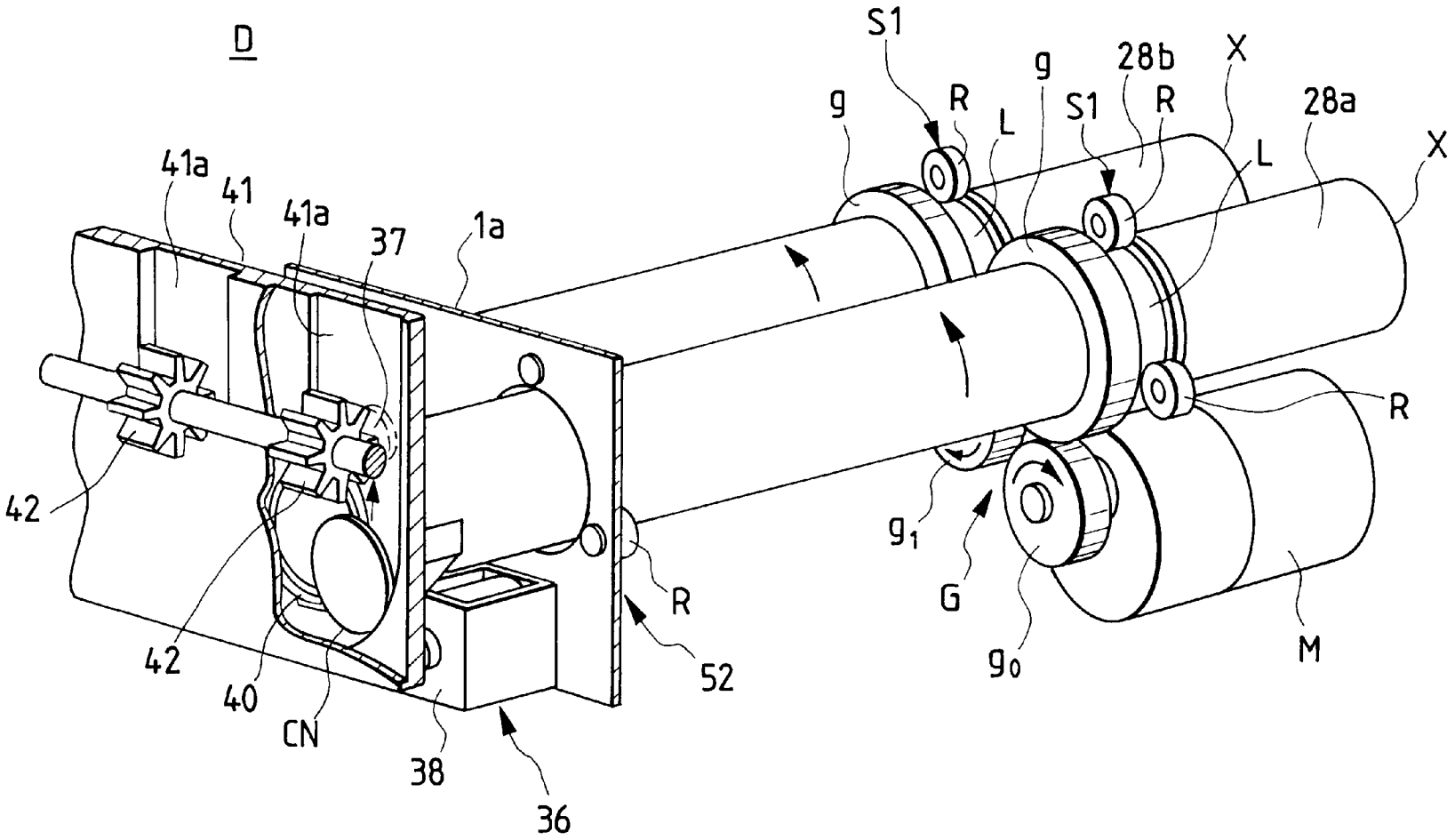
FIG. 5 is a perspective view showing a part of a device for storing and dispensing coins separately according to monetary denominations in the machine shown in FIG. 1.

As shown in FIGS. 4 and 5, in the section D, the rotary cylinders 28*a* through 28*f* are arranged side by side. The rotary cylinder 28*a* through 28*e* are equal in inside diameter (described later), and only the 500-yen coin rotary cylinder 28*f* is larger in diameter than the others (among the coins in Japan, a 500-yen coin being largest in diameter). Hence, the coin storing and dispensing sections for the rotary cylinders 28*a* through 28*f* are substantially equal in structure to each other. Each of the upper roller support mechanisms Si is made up of three idle rollers R which are arranged at angular intervals of 120° in such a manner that they are in rolling contact with a rolling raceway surface L with a flange which is a part of the outer cylindrical surface of the rotary cylinder 18. Those idle rollers R are rotatably supported on a bracket (not shown). Each of the lower roller support mechanisms S2 is also made up of three idle rollers R which are arranged at angular intervals of 120° in such a manner that they are in rolling contact with a rolling raceway surface L with a flange which is a part of the outer cylindrical surface of the rotary cylinder 18. Those idle rollers R are rotatably supported on a bracket 1*a*.

As shown in FIG. 5, the rotating mechanism G comprises: the output spur gear $g_0$ of only one drive motor M which is arranged in the space defined by the bottom of the machine body and the coin receiving inlet of the rotary cylinder 28*a* set inclined; driven spur gears g of the rotary cylinder 28*a* through 28*f* which are provided near the upper raceway surfaces L; and relay spur gears $g_1$ which are rolled between the driven spur gears g. The output spur gear $g_0$ of the drive motor M is engaged with the driven spur gear g of the rotary cylinder 28*a* on one side, to transmit its torque thereto. Hence, the torque is transmitted through the relay spur gears $g_1$ to the driven spur gear g of the rotary cylinder 28*f* at the last stage. The rotating mechanism G is designed as described above. Hence, the drive source can be only one drive motor M, which simplifies the driving system of the machine.

The coin dispensing mechanisms 36, as shown in FIG. 5, comprise: coin dispensing operation starting solenoids 38; coin jumping pawls 40 which are caused to go in and out of the cylindrical surfaces of the lower end portions of the rotary cylinders 28*a* through 28*f* by the plungers of the solenoids 38, respectively; and coin jumping vane wheels 42 of elastic material such as rubber each of which, among the coins CN in the coin jumping passageways 41*a* of an end retaining board 41, accelerates a coin CN which is jumped above the respective coin jumping pawl 40. Whenever the rotary cylinder makes one revolution, one coin is readily jumped up by the coin jumping pawl 40. This is because the coins are lined up sidewise, and therefore not so great load is applied to the lowermost coin. Hence, without use of special conveying means, the jumped coin covers the head drop of the rotary cylinder, and regains a potential for dropping into the coin dispensing outlet 43. In FIG. 3, reference numeral 37 designates a counter sensor for detecting the passage of a coin CN which is sent out.

Figure 6A:
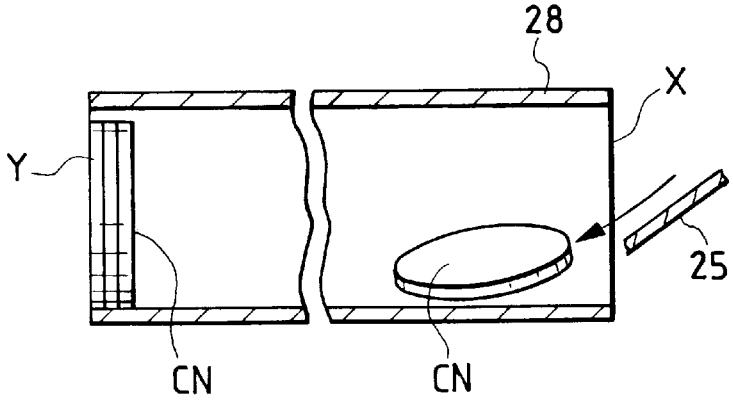
FIGS. 6A to 6B are a vertical sectional side view and a front view, respectively, showing a coin which has been just inserted into a rotary cylinder.
Figure 6B:
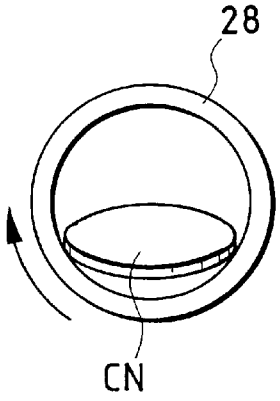
Figure 6C:
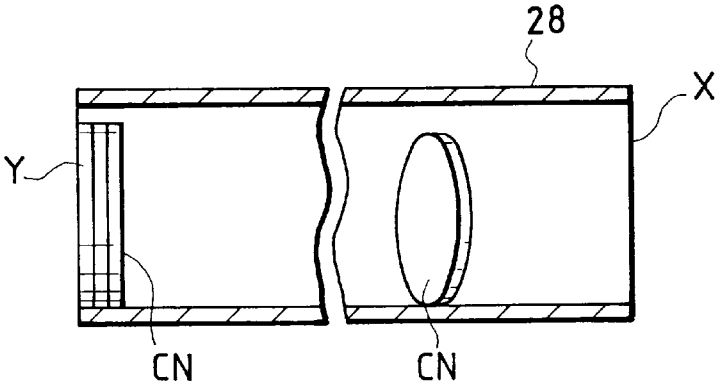
FIGS. 6C and 6D are a vertical sectional side view and a front view, respectively, showing the coin which has just stood up.
Figure 6D:
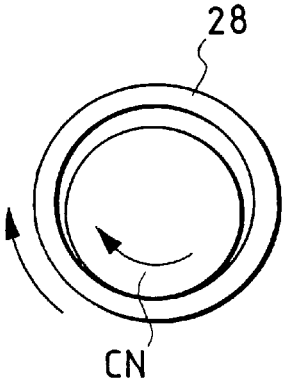
Figure 6E:
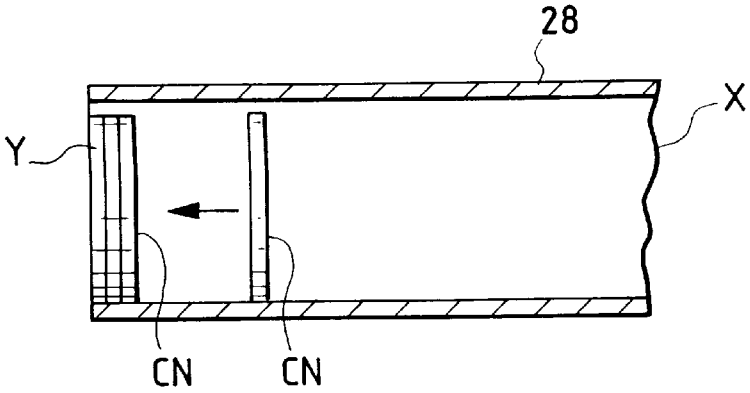
FIG. 6E is a vertical sectional side view showing the coin thus stood which is being slid down the rotary cylinder.
Figure 7B:
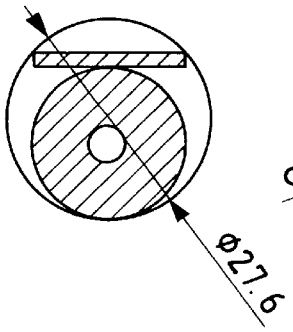
FIGS. 7A to 7F are explanatory diagrams for a description of the combination of coins different in monetary denominations and rotary cylinders provided separately according to the momentary denominations of the coins.
Figure 7A:
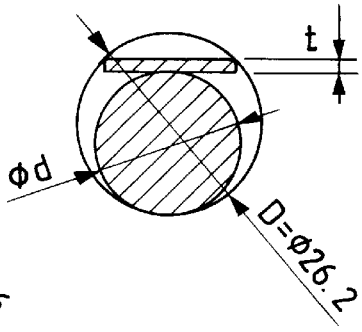
Figure 7D:
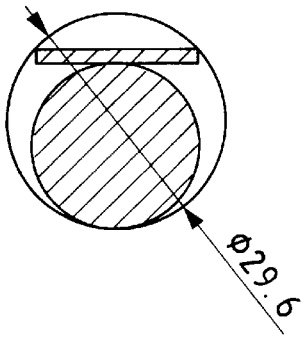
Figure 7C:
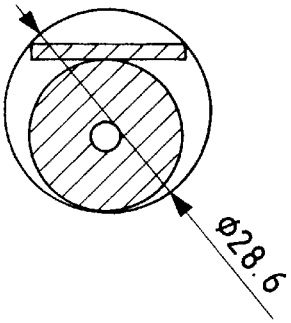
Figure 7F:
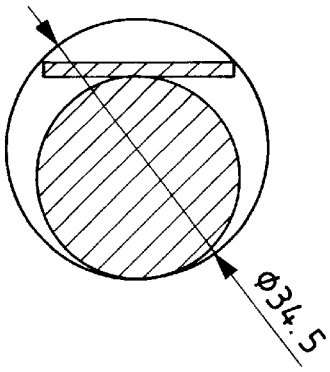
Figure 7E:
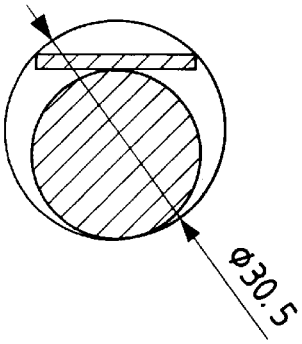

Coins CN are sent from the coin distinguishing holes 24 (24*a* through 24*f*) through the coin chutes 25 (25*a* through 25*f*) to the coin receiving inlets X of the rotary cylinders 28 (28*a* through 28*f*), respectively (cf. FIG. 3, and FIGS. 6A and 6B). Generally, each of the coins thus sent is held fallen down on the lower portion of the inner cylindrical surface of the respective rotary cylinder 28. However, since the rotary cylinder 28 is being turned, the coin CN thus fallen down tends to turn over while being inclined towards the upper portion of the inner cylindrical surface of the rotary cylinder together with the inner cylindrical surface which is being turned; that is, the coin is not completely turned over—it is turned over in such a manner that it is not horizontally balanced. Hence, the inner cylindrical surface of the rotary cylinder 28 produces a reaction to twist the coin surface, so that the periphery of the coin twisted when turned over contacts the inner cylindrical surface of the rotary cylinder 28 again, whereby a force of turning over the coin thus fallen down is decreased; however, a rotary torque causing the periphery of the coin to rub the inner cylindrical surface of the rotary cylinder in the direction of a tangent thereto is allowed to act continuously for a while. Hence, as shown in the FIGS. 6C and 6D, as the rotary cylinder 28 makes about one or two revolutions, the turning over of the coin is stopped, and the coin CN is held stood by the rotary inertia (taking a standing posture). The coin thus stood starts to turn in synchronization with the rotary cylinder 28 with the periphery of the coin in contact with the lower portion of the inner cylindrical surface of the rotary cylinder 28. In this connection, it should be noted that the rotary cylinder 28 is inclined (about 5°). Hence, as shown in FIG. 6E, the stood coin CN is slid down the lower portion of the inner cylindrical surface of the rotary cylinder 28 thus inclined, and lined up at the lower end Y. In the case where the lower end of the rotary cylinder is closed, the sliding of the coin is stopped there. Thus, the coins which are sent one after another are lined up while being held stood. Since, the rotary cylinder 28 is long, a number of coins can be lined up in this manner.

As was described above, the rotary cylinders 28 are held substantially horizontally (being slightly inclined). This feature makes it possible to store a predetermined number of coin in such a manner that they are in line, and to reduce the height of the coin storing section. The drive system for rotating rotary cylinders 28 can be made up of gear mechanisms and frictional wheels. Therefore, the machine is simpler in structure than the conventional one in which the coin storing sections employ coin dispensing endless belts, and the coin storing sections can be reduced in width. It is not dependent on the angle of inclination of the rotary cylinders 28 to cause coins to stand; however, in order to decrease the coin slide-down distance, and to reduce the height of the machine, the angle of inclination of the rotary cylinders is preferably in a range of from 3° to 45°. In practice, this angle depends on the state of the surface (pattern, milled edge or serrations) of a coin to be stood and the condition of the inner cylindrical surface of the respective rotary cylinder 28.

In the case where the inside diameter D of the horizontally extended rotary cylinder is much larger than the diameter d of a coin to be stood, the following problems are involved: When coins are inserted in rapid succession the bridging of coins (stood and fallen coins being laid one on another) occurs with high frequency as shown in FIGS. 7A through 7F. In addition, since the diameter is larger, the coins are not completely stood in line when lined up. In order to eliminate the bridging of coins (as shown in FIGS. 7A through 7F), the following expression should be satisfied:

$$d<D<\{(d+t)^2+d^2/4\}/(d+t)$$

where t is the thickness of a coin.

Figure 8:
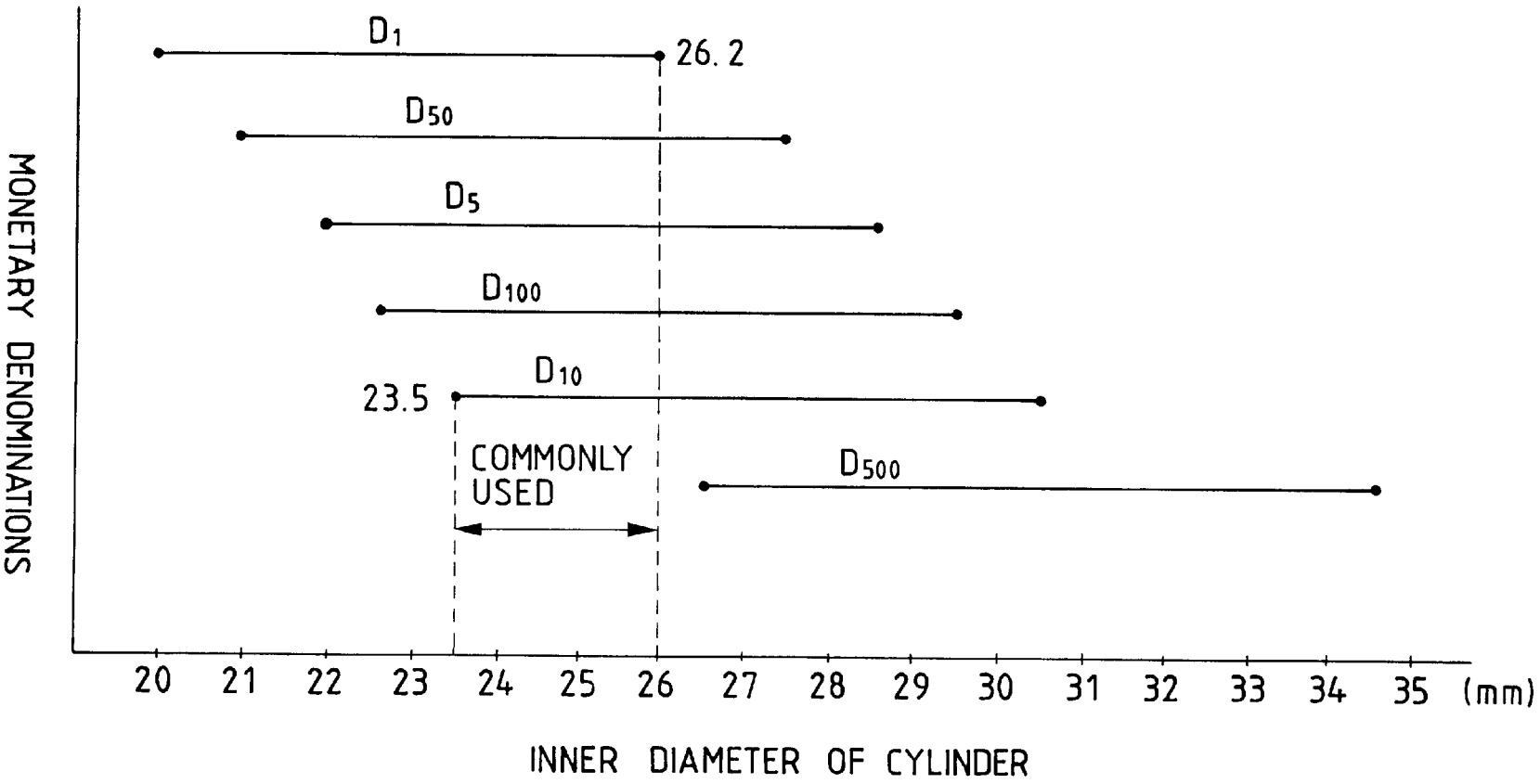
FIG. 8 is a graphical representation indicating relationships between the inside diameters of rotary cylinders provided separately according to the monetary denominations.

As shown in FIG. 8, the inside diameter $D_1$ of the 1-yen coin rotary cylinder ($D_1$=20.0 mm, $t_1$=1.5 mm) is defined as follows:

$$20\ \text{mm}<D_1<26.2\ \text{mm}$$

The inside diameter $D_{50}$ of the 50-yen coin rotary cylinder ($D_{50}$=21.0 mm, $t_{50}$=1.75 mm) is defined as follows:

$$21\ \text{mm}<D_{50}<27.6\ \text{mm}$$

The inside diameter $D_5$ of the 5-yen coin rotary cylinder ($D_5$=22.0 mm, $t_5$=1.5 mm) is defined as follows:

$$22\ \text{mm}<D_5<28.6\ \text{mm}$$

The inside diameter $D_{100}$ of the 100-yen coin rotary cylinder ($D_{100}$=22.6 mm, $t_{100}$=1.7 mm) is defined as follows:

$$22.6\ \text{mm}<D_{100}<29.6\ \text{mm}$$

The inside diameter $D_{10}$ of the 10-yen coin rotary cylinder ($D_{10}$=23.5 mm, $t_{10}$=1.5 mm) is defined as follows:

$$23.5\ \text{mm}<D_{10}<30.5\ \text{mm}$$

The inside diameter $D_{500}$ of the 500-yen coin rotary cylinder ($D_{500}$=26.5 mm, $t_{500}$=1.8 mm) is defined as follows:

$$26.5\ \text{mm}<D_{500}<34.5\ \text{mm}$$

Hence, 1-yen, 50-yen, 5-yen, 100-yen and 10-yen rotary cylinders 28*a* through 28*e* may be the same ones whose inside diameter is larger than 23.5 mm and smaller than 26.2 mm.

If the speed of rotation of the rotary cylinder is excessively slow, then the rotary inertia is not accelerated, and it is difficult to stand a coin or to quickly stand a coin. It has been found through experiments that, when the speed of rotation of the rotary cylinder 28 is about 2 rps in minimum, it is possible to cause a coin to stand. If, on the other hand, the speed of rotation of the rotary cylinder is excessively high, then the centrifugal force is accelerated as much. As a result, a coin fallen down is revolved while being stuck to the inner cylindrical surface of the rotary cylinder, thus being unable to stand up. According to experiments performed by the inventor, when the highest speed of rotation of the rotary cylinder 28 at which the coin was stood up (not being revolved) was 5 rps.

In order to cause a coin to stand up, it is essential to produce a rotary torque continuously for a while which causes the periphery of a coin to rub the inner cylindrical surface of the rotary cylinder in the direction of a tangent thereto. However, in the embodiment of the invention, the inner cylindrical surface of each of the rotary cylinders 28 is made rough; that is, it has a coin rubbing surface in the direction of a generating line thereof. Hence, the periphery of a coin is positively caused to rub the coin rubbing surface; that is, the coin is positively stood up.

In the embodiment, in order that coins are lined up after being stood up, each of the rotary cylinders 28 is in the form of a long pipe; however, the invention is not limited thereto or thereby. That is, the rotary cylinder may be so designed that it causes coins to stand up only, not storing the coins (the coin storing section being provided separately).

The above-described machine of the invention handles Japanese coins; however, the invention is not limited thereto or thereby. That is, the technical concept of the invention may be applied to foreign coins, and even to medals used for game machines.

As was described above, a specific feature of the invention resides in that the substantially horizontally laid rotary cylinder is employed which continuously applies a frictional force to an inserted coin along the periphery thereof. Hence, the invention has the following effects or merits:

(1) Although the rotary cylinder is laid horizontally, a coin inserted therein is stood up. Hence, a number of coins can be stored in such a manner that they are lined up in a line. Since the rotary cylinder is laid horizontally, the device can be reduced in height. The drive system for rotating the rotary cylinder is simple in construction than the conventional one in which the coin storing section employs the coin dispensing endless belts, and the coin storing section is reduced in width. In the horizontally laid rotary cylinder, the weight of the lined-up coins is scarcely applied to the coin dispensing means, and therefore the latter can be simplified in structure.

(2) In the case where the angle of inclination of the rotary cylinder is in a range of from 30°to 45°, preferably 3° to 30°, not only the coin sliding distance but also the height of the device can be sufficiently reduced.

(3) In the case where the following expression is satisfied, the bridging of coins may be eliminated which are inserted in rapid succession:

$$d<D<\{(d+t)^2+d^2/4\}/(d+t)$$

where d is the diameter of a coin to be stood up, t is the thickness of the coin, and D is the inside diameter of the rotary cylinder.

(4) In the case where the speed of rotation of the rotary cylinder is in a range of from 2 rps to 5 rps, the coin is positively stood up.

(5) In the case where at least a part of the inner cylindrical surface of the rotary cylinder is formed into the coin rubbing surface), the periphery of the coin is positively brought into frictional contact with the coin rubbing surface, and therefore the coin is positively stood up.

(6) The coin line-up device has the rotary supporting mechanisms on the rotary cylinder on both ends which are in rolling contact with the outer cylindrical surface of the rotary cylinder. Hence, a long rotary cylinder can be supported with ease, and the frictional loss is reduced as much.

(7) Moreover, the device comprises the rotating mechanism having a driven wheel on the outer cylindrical surface of the rotary cylinder, which simplifies the arrangement of the driving system as much. Especially in the case where the rotating mechanism is arranged on the side of the coin receiving inlet, the space defined by the bottom of the body of the machine and the coin receiving inlet of the rotary cylinder can be effectively utilized, which makes it possible to decrease the height of the device.

(8) The device for storing and dispensing coins separately according to the monetary denominations, and the circulation type coin take in and out machine according to the invention, employs the above-described coin line-up device. This feature makes it possible to decrease the height of the device and to make the device compact, thereby to increase the coin storing capacity and to standardize the coin dispensing time.

(9) In addition, the device for storing and dispensing coins separately according to the monetary denominations is provided in the form of a cassette which can be detachably loaded in the body of machine. This feature enhances one lump collection of coins, and contributes to the maintenance and inspection of the device.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A coin line-up device, comprising:

a plurality of rotary cylinders for retaining sorted coins, each having a central axis and an upper opening as a coin receiving inlet, said rotary cylinders being laid substantially parallel to each other, the central axes of the rotary cylinders being inclined at a predetermined angle;

a driven wheel disposed around an outer cylindrical surface of each of the cylinders;

a rotating mechanism having an output wheel coupled to the driven wheel for simultaneously rotating the plurality of rotary cylinders.

2. A coin line-up device as claimed in claim 1, wherein said predetermined angle of said central axis is in a range of from 3° to 30°.

3. A coin line-up device as claimed in claim 1, wherein the following expression is satisfied:

$$d<D<\{(d+t)^2+d^2/4\}/(d+t)$$

where d is the diameter of a coin to be stood up, t is the thickness of said coin, and D is the inside diameter of said rotary cylinders.

4. A coin line-up device as claimed in claim 1, wherein the speed of rotation of said rotary cylinders is in a range of from 2 rps to 5 rps.

5. A coin line-up device as claimed in claim 1 wherein an inner cylindrical surface of said rotary cylinders includes at least partially a coin rubbing surface.

6. A coin line-up device as claimed in claim 1, further comprising a rotary supporting mechanism on said rotary cylinders at both ends which are in rolling contact with the outer cylindrical surface of said rotary cylinders.

7. A coin line-up device as claimed in claim 1, wherein said rotating mechanism is arranged on the side of said coin receiving inlet.

8. A device for receiving and dispensing coins separately according to monetary denominations, comprising:

a coin line-up device including a plurality of rotary cylinders, each having a central axis and an upper opening as a coin receiving inlet, said rotary cylinders being laid substantially parallel to each other, the central axes of the rotary cylinders being inclined at a predetermined angle;

means for rotating each of said rotary cylinders; and coin dispensing means provided on said rotary cylinders at a lower end thereof, for dispensing a coin from said rotary cylinders.

9. A device as claimed in claim 8, wherein said predetermined angle of said central axis of said rotary cylinder is in a range of from 3° to 30°.

10. A device as claimed in claim 8, wherein the following expression is satisfied:

$$d<D<\{(d+t)^2+d^2/4\}/(d+t)$$

where d is the diameter of a coin to be stood up, t is the thickness of said coin, and D is the inside diameter of said rotary cylinders.

11. A device as claimed in claim 8, wherein the speed of rotation of said rotary cylinders is in a range of from 2 rps to 5 rps.

12. A device as claimed in claim 8, wherein an inner cylindrical surface of said rotary cylinders at least partially includes a coin rubbing surface.

13. A device as claimed in claim 8, wherein further comprising a rotary supporting mechanism on said rotary cylinder at both ends which are in rolling contact with an outer cylindrical surface of said rotary cylinders.

14. A device as claimed in claim 8, further comprising a rotating mechanism having a driven wheel on an outer cylindrical surface of said rotary cylinders.

15. A device as claimed in claim 8, wherein said rotating mechanism is arranged on the side of said coin receiving inlet.

16. A device as claimed in claim 8, wherein said coin dispensing means includes a coin jumping and discharging member.

17. A circulation-type coin take in and out machine, comprising:

a coin receiving and dispensing section which has a coin receiving inlet, and is adapted to dispense a plurality of coins one at a time which have been collectively inserted into said coin receiving inlet;

a coin sorting section for sorting out the coins dispensed from said coin receiving and dispensing section while conveying the coins;

a storage and dispensation section for storing and dispensing coins separately according to monetary denominations which stores said coins separately according to monetary denominations which have been sorted out by said coin sorting section, and in response to a coin dispensing instruction, dispenses said coins one at a time from a section for storing coins separately according to monetary denominations, said storage and dispensation section having a coin line-up device including rotary cylinders each of which has an upper opening as a coin receiving inlet, said rotary cylinders being laid substantially horizontally with a central axis thereof inclined with a predetermined angle, and means for rotating said rotary cylinders; and coin dispensing means provided on said rotary cylinders at a lower end thereof, said coin dispensing means dispensing a coin from of said rotary cylinders; and dispensed-coin guiding section which guides a coin to a coin dispensing outlet which has been dispensed from said section for storing coins separately according to monetary denominations.

18. A machine as claimed in claim 17, wherein said storage and dispensation section is of cassette type, being detachably mounted on a body of said machine.

* * * * *

UNITED STATES PATENT AND TRADEMARK OFFICE

CERTIFICATE OF CORRECTION

PATENT NO. : 5,911,622
DATED : June 15, 1999
INVENTOR(S) : Kinoshita et al.

It is certified that error appears in the above-identified patent and that said Letters Patent is hereby corrected as shown below:

On the Title Page, Item [57], in the Abstract, line 6, "30° to 30°" should read --3° to 30°--.

Claim 5, column 12, line 19, after "claim 1", insert --,--.

Claim 9, column 12, line 43, "cylinder" should read --cylinders--.

Claim 17, column 14, line 10, after "from", delete "of".

Signed and Sealed this
Twenty-fifth Day of January, 2000

*Attest:*

*Attesting Officer*

*Acting Commissioner of Patents and Trademarks*